US010950978B2

(12) United States Patent
Shioda

(10) Patent No.: US 10,950,978 B2
(45) Date of Patent: Mar. 16, 2021

(54) CONNECTOR WITH PREVENTION OF LOPSIDEDNESS IN A MOVABLE REGION OF A MOVABLE HOUSING WITH RESPECT TO A FIXED HOUSING

(71) Applicant: IRISO ELECTRONICS CO., LTD., Yokohama (JP)

(72) Inventor: Hideki Shioda, Yokohama (JP)

(73) Assignee: IRISO ELECTRONICS CO., LTD., Yokohama (JP)

( * ) Notice: Subject to any disclaimer, the term of this patent is extended or adjusted under 35 U.S.C. 154(b) by 0 days.

(21) Appl. No.: 16/693,836

(22) Filed: Nov. 25, 2019

(65) Prior Publication Data

US 2020/0176930 A1 Jun. 4, 2020

(30) Foreign Application Priority Data

Nov. 29, 2018 (JP) ..... JP2018-224218

(51) Int. Cl.

| | |
|---|---|
| ***H01R 13/631*** | (2006.01) |
| ***H01R 13/11*** | (2006.01) |
| ***H01R 13/502*** | (2006.01) |
| ***H01R 24/60*** | (2011.01) |
| *H01R 107/00* | (2006.01) |

(52) U.S. Cl.

CPC ..... *H01R 13/6315* (2013.01); *H01R 13/112* (2013.01); *H01R 13/502* (2013.01); *H01R 24/60* (2013.01); *H01R 2107/00* (2013.01)

(58) Field of Classification Search

CPC ..... H01R 13/6315; H01R 13/112; H01R 13/502; H01R 24/60; H01R 2107/00

USPC ..... 439/247

See application file for complete search history.

(56) References Cited

U.S. PATENT DOCUMENTS

| | | | | |
|---|---|---|---|---|
| 7,354,279 | B2 * | 4/2008 | Uesaka | H01R 12/57 439/660 |
| 9,160,105 | B2 * | 10/2015 | Takaki | H01R 13/113 |
| 9,331,414 | B2 * | 5/2016 | Doi | H01R 13/24 |
| 9,484,656 | B2 * | 11/2016 | Doi | H01R 13/41 |
| 9,698,508 | B2 * | 7/2017 | Kobayashi | H01R 12/91 |
| 10,230,187 | B2 * | 3/2019 | Hasegawa | H01R 13/5025 |
| 2009/0239421 | A1 * | 9/2009 | Fukazawa | H01R 12/91 439/660 |

(Continued)

FOREIGN PATENT DOCUMENTS

| | | | |
|---|---|---|---|
| EP | 3076490 | A1 | 10/2016 |
| JP | 2006085944 | A | 3/2006 |

(Continued)

OTHER PUBLICATIONS

Extended European search report for European Patent Application No. 19211377.7 dated Apr. 20, 2020, 12 pages.

*Primary Examiner* — Peter G Leigh

(74) *Attorney, Agent, or Firm* — Westman, Champlin & Koehler, P.A.

(57) ABSTRACT

A connector includes a fixed housing provided with a first side wall extending along an array direction of plural signal terminals, and a second side wall extending along an array-orthogonal direction that is orthogonal to both a fitting direction and the array direction. Each of the signal terminals spans between the first side wall and a movable housing, and a power source terminal span between the second side wall and the movable housing.

3 Claims, 14 Drawing Sheets

(56) References Cited

U.S. PATENT DOCUMENTS

| | | | | |
|---|---|---|---|---|
| 2010/0029134 | A1* | 2/2010 | Matsuzaki | H01R 12/716 439/607.57 |
| 2012/0135621 | A1* | 5/2012 | Hayauchi | H01R 12/91 439/247 |
| 2015/0044901 | A1 | 2/2015 | Doi et al. | |
| 2015/0044915 | A1 | 2/2015 | Takaki | |
| 2015/0064935 | A1* | 3/2015 | Funayama | H01R 13/46 439/1 |
| 2015/0132999 | A1* | 5/2015 | Sato | H01R 24/60 439/676 |
| 2015/0270658 | A1* | 9/2015 | Aoki | H01R 12/716 439/660 |
| 2016/0204536 | A1 | 7/2016 | Doi et al. | |
| 2016/0294089 | A1* | 10/2016 | Kobayashi | H01R 12/716 |
| 2016/0294111 | A1* | 10/2016 | Kobayashi | H01R 12/716 |
| 2017/0338592 | A1* | 11/2017 | Doi | H01R 12/7035 |
| 2018/0138618 | A1* | 5/2018 | Hasegawa | H01R 12/91 |
| 2019/0013608 | A1 | 1/2019 | Yoshida | |
| 2019/0157806 | A1* | 5/2019 | Suzuki | H01R 13/26 |

FOREIGN PATENT DOCUMENTS

| | | | |
|---|---|---|---|
| JP | 2007220327 | A | 8/2007 |
| JP | 2014-235974 | A | 12/2014 |
| JP | 5946804 | B2 | 7/2016 |
| JP | 6025196 | B2 | 11/2016 |
| JP | 2017-120696 | A | 7/2017 |
| JP | 6227103 | B2 | 11/2017 |
| JP | 2018-116945 | A | 7/2018 |

* cited by examiner

CONNECTOR WITH PREVENTION OF LOPSIDEDNESS IN A MOVABLE REGION OF A MOVABLE HOUSING WITH RESPECT TO A FIXED HOUSING

CROSS-REFERENCE TO RELATED APPLICATION

This application is based on and claims priority under 35 USC 119 from Japanese Patent Application No. 2018-224218 filed on Nov. 29, 2018, the disclosure of which is incorporated by reference herein.

BACKGROUND

Technical Field

The present disclosure relates to a connector, and more specifically relates to a connector including signal terminals and a power source terminal, and in which a movable housing is capable of moving relative to a fixed housing.

Related Art

Japanese Patent Application Laid-Open (JP-A) No. 2017-120696 discloses a floating connector device including a fixed housing that is fixed to a substrate, a movable housing that is capable of moving with respect to the fixed housing, and a contact group with one end portion fixed to the substrate in an array pattern, and with another end portion fixed to the movable housing in an array pattern running in a length direction of the movable housing. The fixed housing includes a pair of long walls extending along a length direction of the fixed housing, a pair of short walls connecting together the respective end portions of the pair of long walls to configure a frame shape, and an elongated through hole. The movable housing includes an outer portion positioned at the exterior of the fixed housing, and an inner portion extending from the exterior to the inside of the elongated through hole. The contact group is configured by multiple plug contacts (signal contacts) arrayed in the length direction of the movable housing, and wide plug contacts (power source contacts) disposed on both sides of the multiple signal contacts in the length direction of the movable housing.

Each of the multiple signal contacts and the power source contacts includes a tail portion mounted to the substrate, a fixed portion supported by the fixed housing, a U-shaped portion supported in a contact support groove formed at the exterior of the movable housing, and an elastic deformation portion in a free state not supported in a groove. The elasticity of the elastic deformation portion enables the movable housing to sink in the direction of the substrate. In this sunken state, elastic movement is possible in the length direction, a direction orthogonal to the length direction, and a tilting direction. This enables not only a movable region of the movable housing in a substrate-parallel direction, but also a movable region of the movable housing in a push-in direction to be enlarged.

SUMMARY

However, in the Related Art described above, each of the multiple signal contacts and the power source contacts spans between the long walls of the fixed housing and the movable housing. In such a configuration, variation in the distance between the short walls of the fixed housing and the movable housing may arise, for example due to dimensional tolerance or assembly tolerance of the individual contacts. If such variation arises, lopsidedness arises in a movable region of the movable housing with respect to the fixed housing.

Smaller circuit board-mounted connectors are being demanded in line with the decreasing size of electronic components in recent years. In the Related Art described above, each of the multiple signal contacts and the power source contacts spans between the long walls of the fixed housing and a long-side face of the movable housing. In such a configuration, attempting to reduce the size of the fixed housing and the movable housing in their respective length directions (a contact array direction) may result in the signal contacts and the power source contacts becoming too close to each other, which could cause short circuiting due to tracking or the like.

In consideration of the above circumstances, an object of the present disclosure is to obtain a connector that facilitates the prevention of lopsidedness in a movable region of a movable housing with respect to a fixed housing, and also facilitates the prevention of short circuiting due to tracking or the like.

A connector of a first aspect of the present disclosure includes a fixed housing to be placed on a substrate, a movable housing disposed so as to be capable of moving relative to the fixed housing, and configured to fit together with a connection target, plural signal terminals arrayed in an array direction that is orthogonal to a fitting direction of the connection target, with each of the signal terminals spanning between the fixed housing and the movable housing, and a power source terminal spanning between the fixed housing and the movable housing. The fixed housing includes a first side wall extending along the array direction, and a second side wall extending along an array-orthogonal direction that is orthogonal to both the fitting direction and the array direction. Each of the plural signal terminals includes a first connection portion retained at the first side wall and fixed to the substrate, a first contact portion retained at the movable housing and configured to electrically connect to the connection target, and an elastically deformable first elastic portion positioned between the first connection portion and the first contact portion. The power source terminal includes a second connection portion retained at the second side wall and fixed to the substrate, a second contact portion retained at the movable housing and configured to electrically connect to the connection target, and an elastically deformable second elastic portion positioned between the second connection portion and the second contact portion.

In the connector of the first aspect, the plural signal terminals and the power source terminal each span between the fixed housing and the movable housing. The first elastic portion of each of the signal terminals and the second elastic portion of the power source terminal elastically deform so as to permit movement of the movable housing relative to the fixed housing.

In this connector, the fixed housing includes the first side wall extending in the array direction of the plural signal terminals, and the second side wall extending in the array-orthogonal direction that is orthogonal to both the fitting direction of the connection target and the array direction. The plural signal terminals span between the first side wall and the movable housing, and the power source terminal spans between the second side wall and the movable housing. Namely, since the respective terminals either span between the first side wall and the movable housing or between the second side wall and the movable housing, the first side wall and the second side wall extending in two mutually orthogonal directions to each other, any variation in the distance between the first side wall and the movable housing and the second side wall and the movable housing can be corrected from these two directions by the plural signal terminals and by the power source terminal. This facilitates the prevention of lopsidedness in a movable region of the movable housing with respect to the fixed housing.

Moreover, in this connector, the plural signal terminals span between the first side wall and the movable housing, separately to the power source terminal that spans between the second side wall and the movable housing. Accordingly, even in case in which the fixed housing and the movable housing are reduced in size along the array direction, the plural signal terminals can be prevented from becoming too close to the power source terminal. This facilitates the prevention of short circuiting due to tracking or the like as a result.

A connector of a second aspect of the present disclosure is the first aspect, wherein second side walls are disposed on both sides in the array direction with respect to the movable housing, and each of a plurality of power source terminals spans between a corresponding second side wall and the movable housing.

In the connector of the second aspect, due to the configuration described above variation in the distance between the second side walls and the movable housing in the array direction can be corrected from mutually opposing directions by the respective power source terminals. This further facilitates the prevention of lopsidedness in the movable region of the movable housing with respect to the fixed housing.

A connector of a third aspect of the present disclosure is the first aspect, wherein the movable housing includes an opposing wall opposing the second side wall in the array direction, the second contact portion is retained at the opposing wall, and elastically deforms toward the plural signal terminals in a case in which an electrical contact is formed with the connection target, and an accommodation recess opening toward an array direction outer side is formed in the opposing wall so as to accommodate at least part of the second contact portion.

In the connector of the third aspect, the movable housing includes the opposing wall opposing the second side wall in the array direction of the plural signal terminals. The second contact portion of the power source terminal is retained at the opposing wall and elastically deforms toward the plural signal terminals in case in which the electrical contact is formed with the connection target. There is accordingly no need to secure a space for elastic deformation of the second contact portion on the opposite side to the plural signal terminals (on the array direction outer side). Moreover, the opposing wall is formed with the accommodation recess that opens toward the array direction outer side and that accommodates at least part of the second contact portion, making it easy to secure placement space for the second contact portion in case in which reducing the size of the overall configuration of the connector in the array direction.

A connector of a fourth aspect of the present disclosure is the first aspect, wherein a spring accommodation recess opening toward the movable housing in the array direction is formed in the second side wall so as to accommodate at least part of the second elastic portion.

In the connector of the fourth aspect, the second side wall of the fixed housing is formed with the spring accommodation recess that opens toward the movable housing in the array direction of the plural signal terminals, and that accommodates at least part of the second elastic portion of the power source terminal. This makes it easy to secure placement space for the second elastic portion in case in which reducing the size of the overall configuration of the connector in the array direction.

A connector of a fifth aspect of the present disclosure is the first aspect, wherein the power source terminal is configured by a sheet member that includes plural bent portions bent about plural bend axes extending along the array-orthogonal direction and that has a sheet thickness direction that is oriented in a direction orthogonal to the array-orthogonal direction, with a portion of the sheet member configuring the second contact portion being disposed with its sheet thickness direction oriented in the array direction.

In the connector of the fifth aspect, the power source terminal is configured by the sheet member that includes the plural bent portions bent about the plural bend axes extending in the array-orthogonal direction, and that has a sheet thickness direction oriented in a direction orthogonal to the array-orthogonal direction. Due to setting the plural bent portions and the sheet thickness direction of the sheet member as described above, the elastic deformability of the second elastic portion of the power source terminal in the array direction can be prevented from suffering even in cases in which the power source terminal is set with a large width dimension in the array-orthogonal direction in order to secure a cross-sectional area of the power source terminal that will allow a larger current to flow through the power source terminal than will flow through the respective signal terminals. Moreover, the portion of the sheet member configuring the second contact portion is disposed with its sheet thickness direction oriented in the array direction, thereby enabling the placement space required for the second contact portion in the array direction to be made smaller.

As described above, the connector according to the present disclosure facilitates the prevention of lopsidedness in the movable region of the movable housing with respect to the fixed housing, and also facilitates the prevention of short circuiting due to tracking or the like.

BRIEF DESCRIPTION OF THE DRAWINGS

Exemplary embodiments of the present disclosure will be described in detail based on the following figures, wherein.

DETAILED DESCRIPTION

Figure 1:
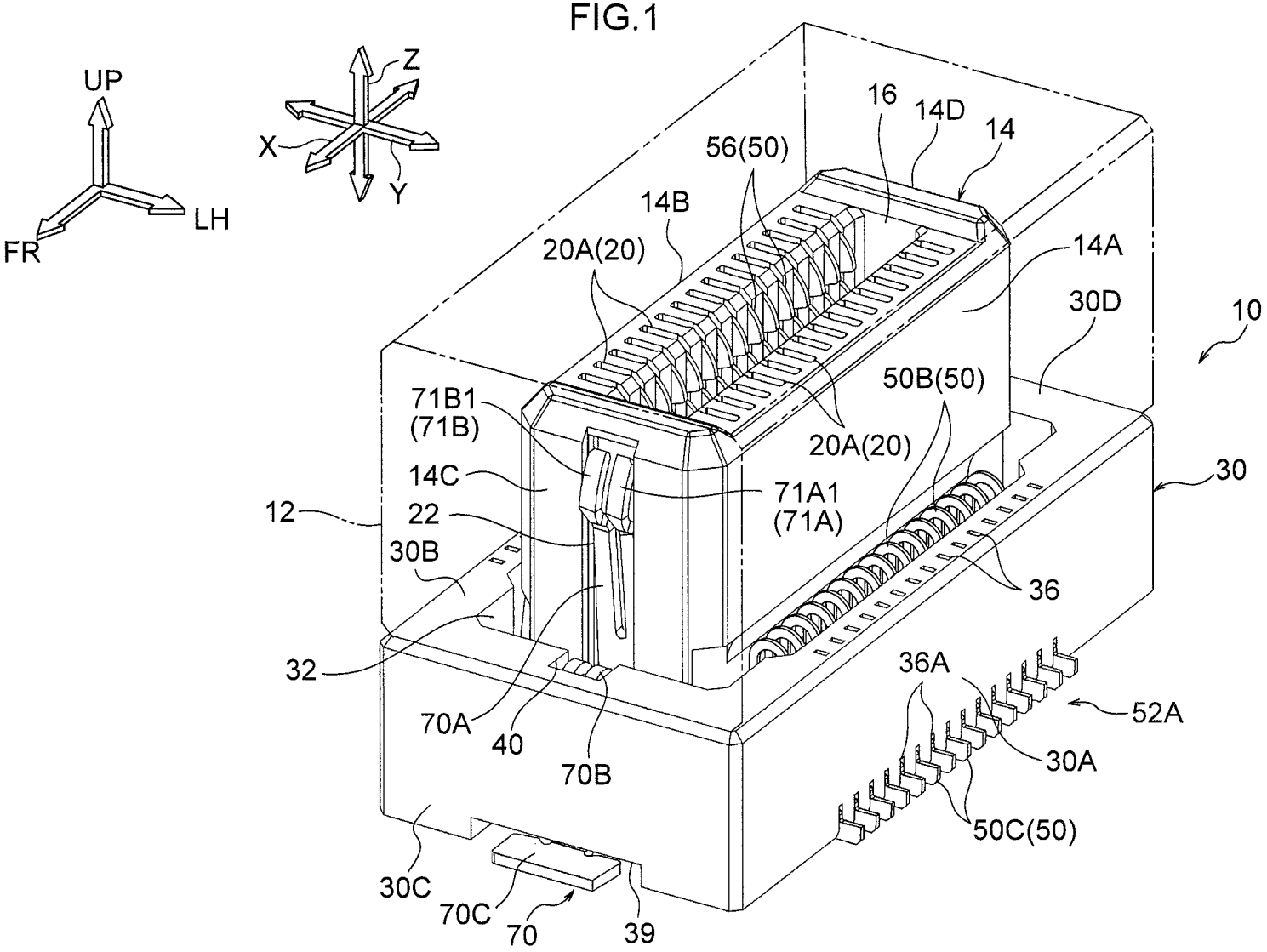
FIG. 1 is a perspective view illustrating a connector according to an exemplary embodiment of the present disclosure.
Figure 2:
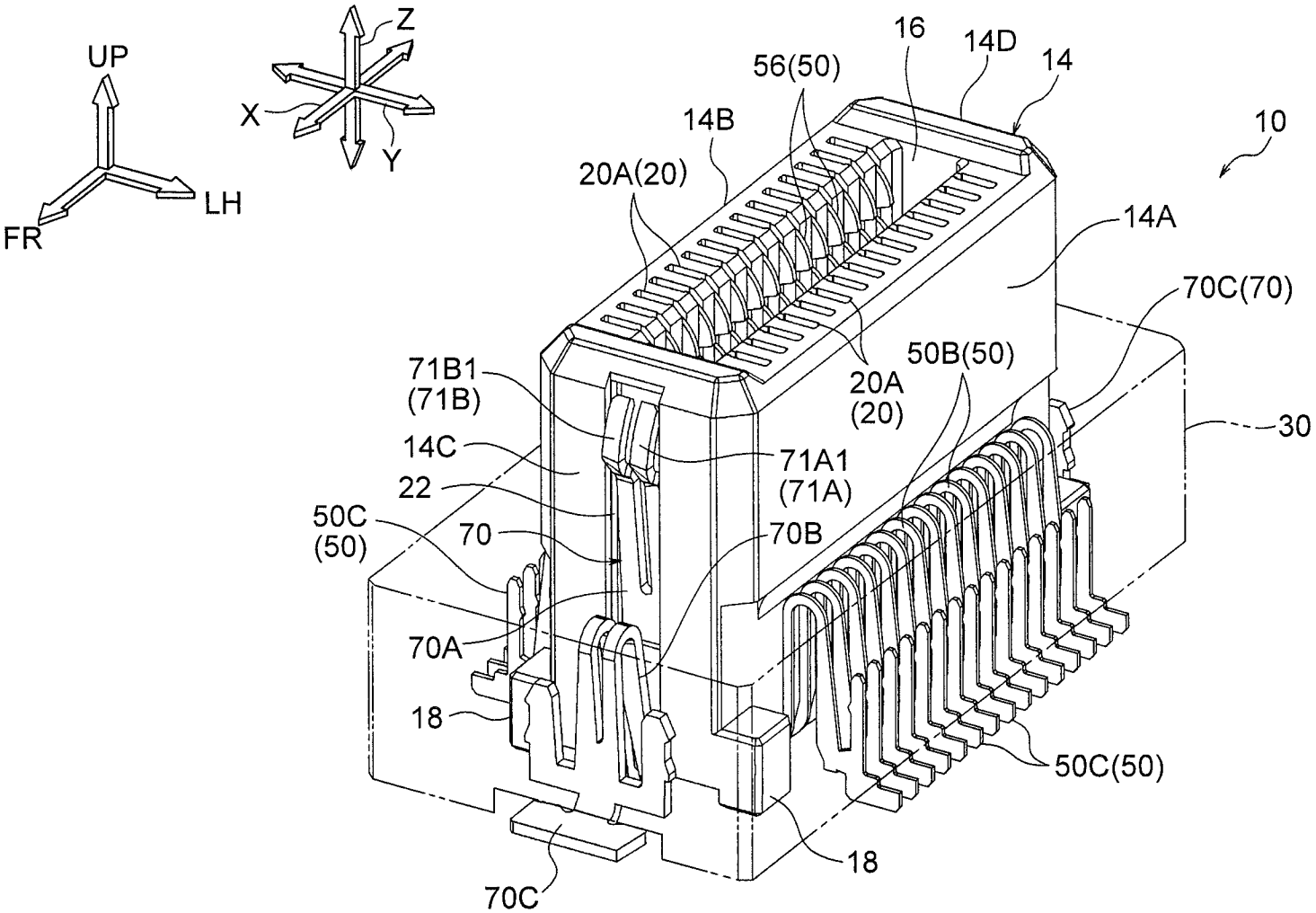
FIG. 2 is a perspective view illustrating corresponding to FIG. 1, illustrating a connector according to an exemplary embodiment of the present disclosure with a fixed housing in a see-through state.
Figure 3:
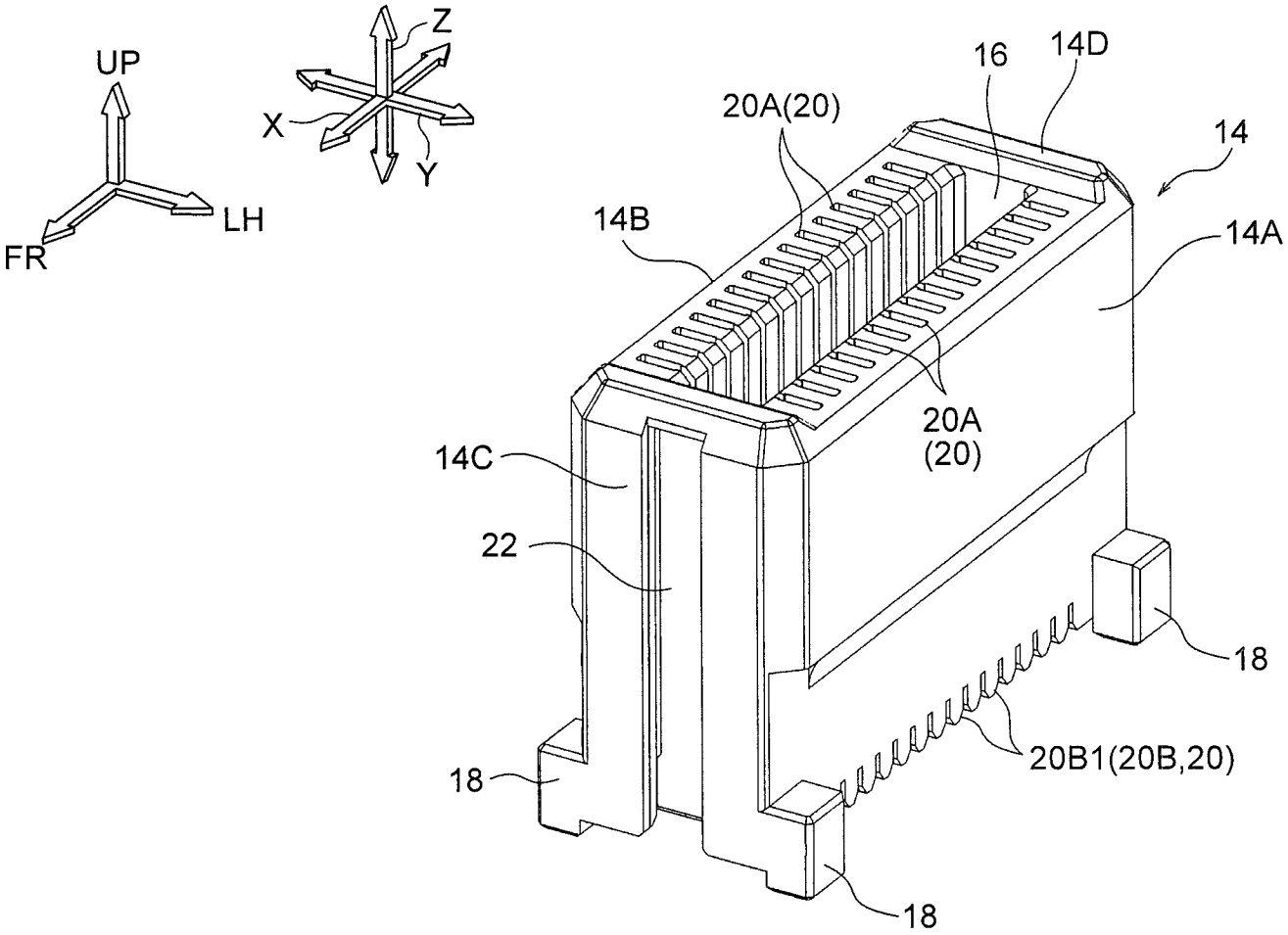
FIG. 3 is a perspective view illustrating a movable housing according to an exemplary embodiment of the present disclosure.
Figure 4:
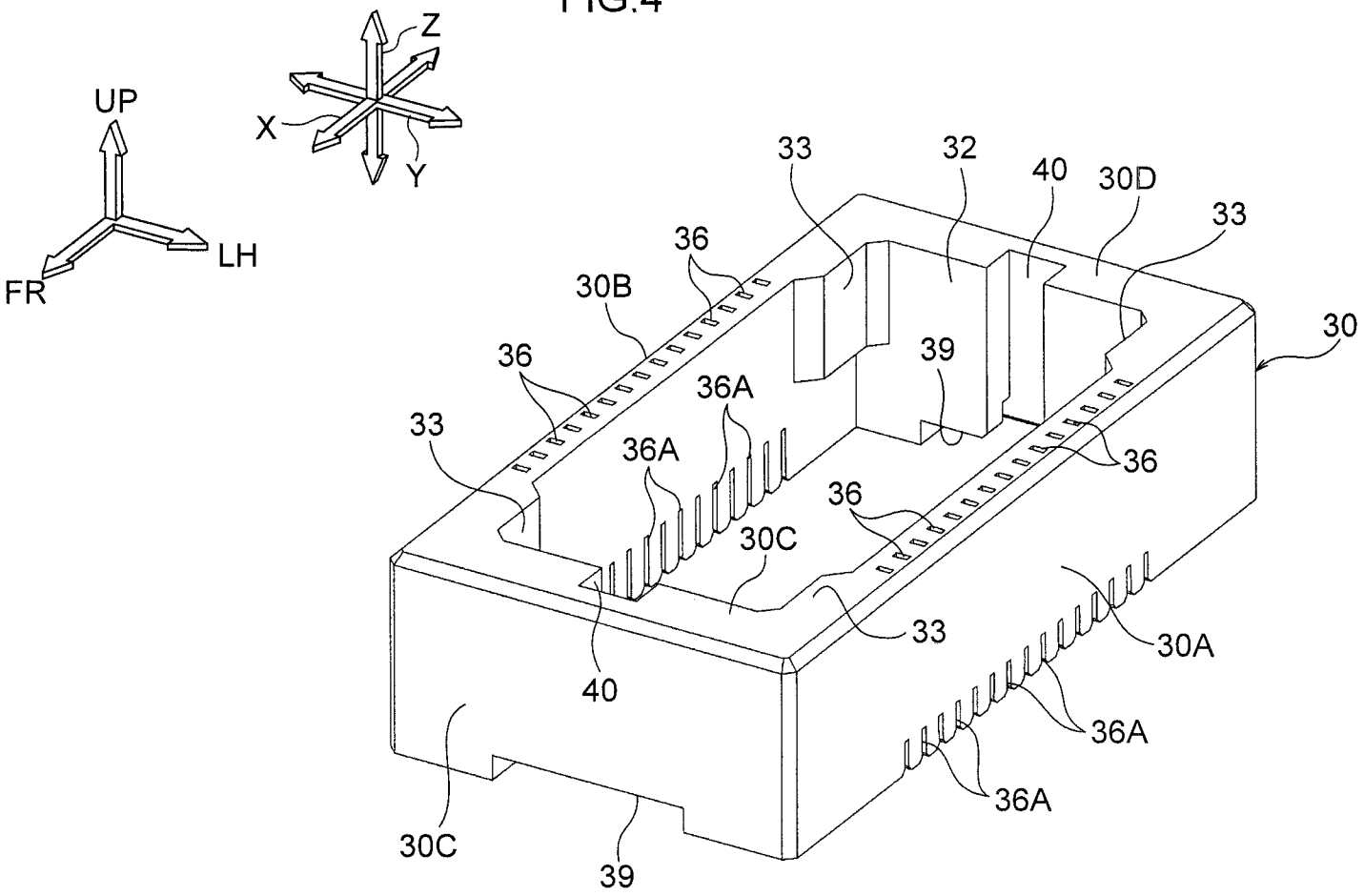
FIG. 4 is a perspective view illustrating a fixed housing according to an exemplary embodiment of the present disclosure.
Figure 5:
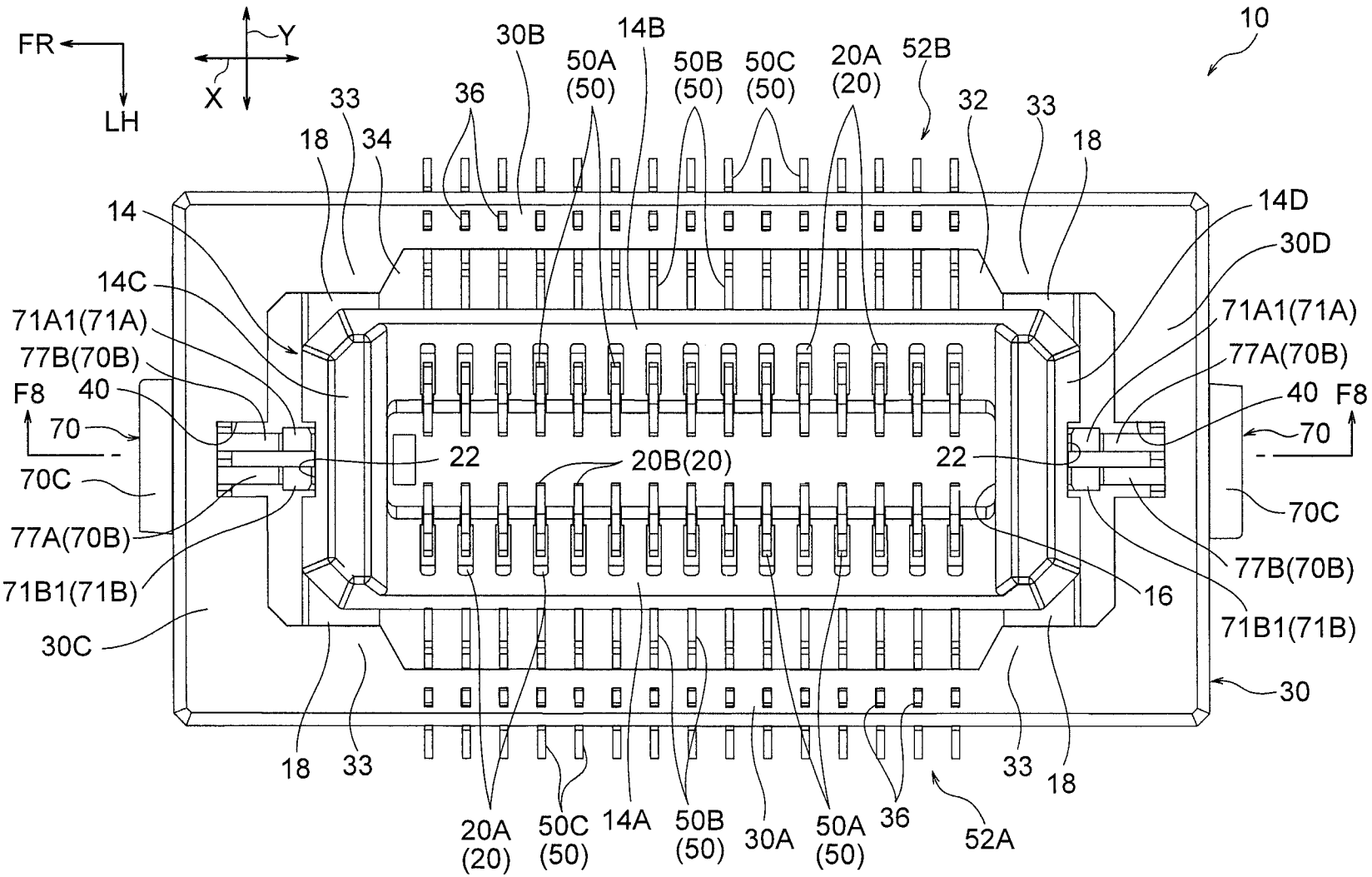
FIG. 5 is a plan view illustrating a connector according to an exemplary embodiment of the present disclosure.
Figure 6:
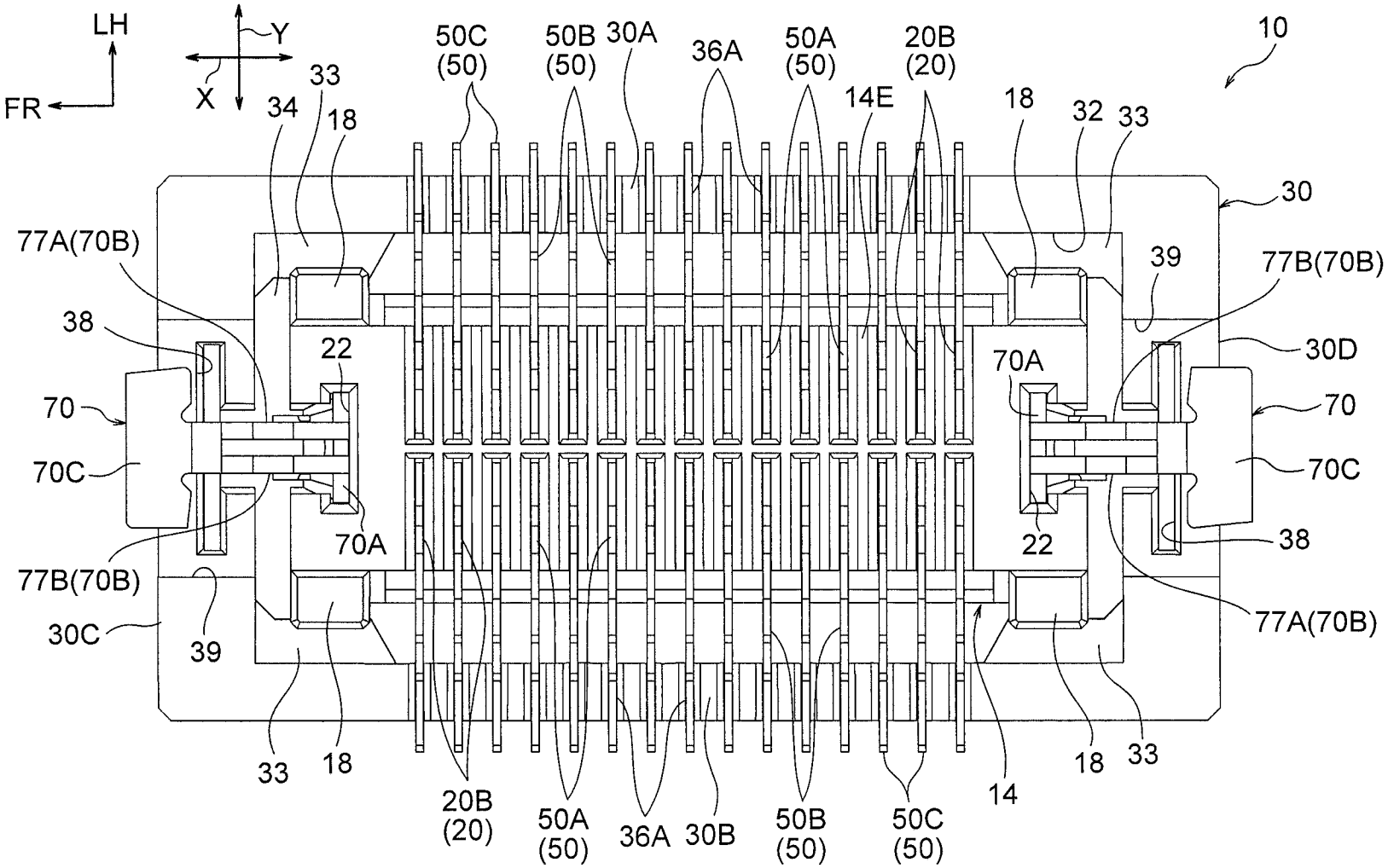
FIG. 6 is a bottom view illustrating a connector according to an exemplary embodiment of the present disclosure.
Figure 7:
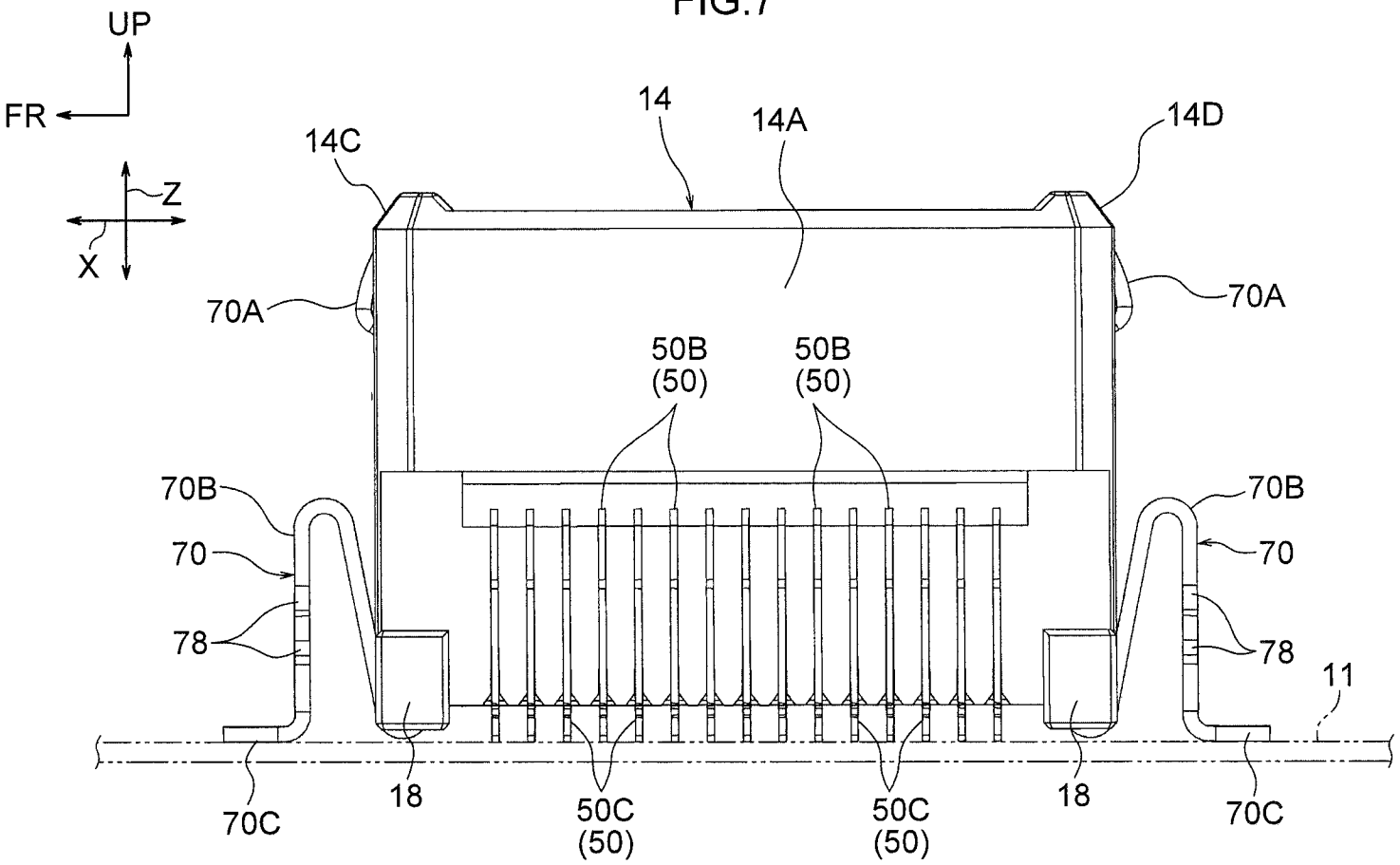
FIG. 7 is a side view illustrating a connector according to an exemplary embodiment of the present disclosure.
Figure 8:
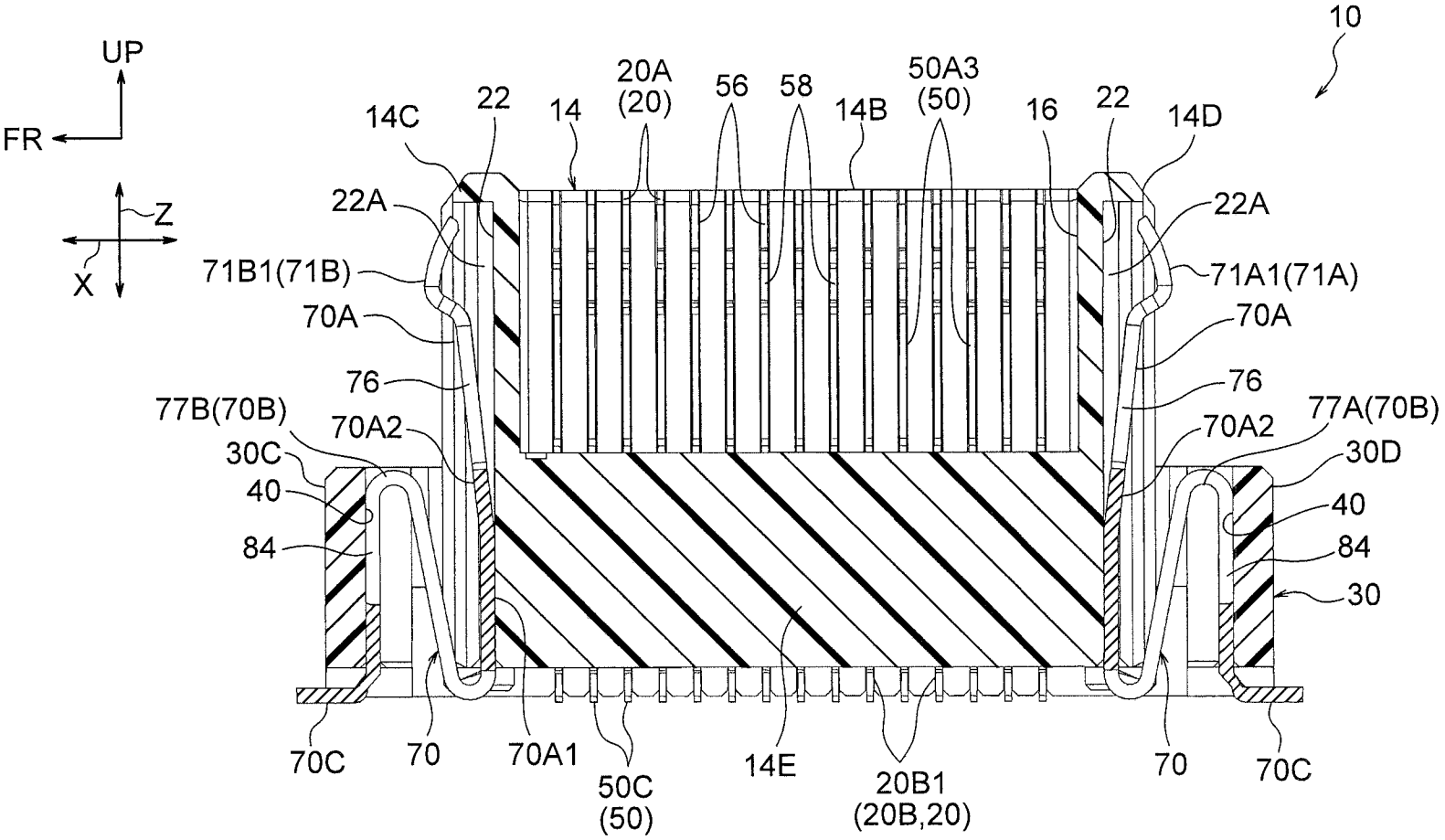
FIG. 8 is a cross-section illustrating a plane sectioned along line F8-F8 in FIG. 5.

Explanation follows regarding a connector 10 according to an exemplary embodiment of the present disclosure, with reference to FIG. 1 to FIG. 14. For ease of explanation, in the drawings, the arrow FR indicates a front direction of the connector 10, the arrow LH indicates a left direction of the connector 10, and the arrow UP indicates an upward direction of the connector 10 as appropriate. In the following explanation, reference simply to front, rear, left, right, upward, and downward directions indicates these directions in relation to the connector 10. These directions are not related to the orientation of the connector 10 when in use. Some reference numerals may be omitted from the respective drawings in the interests of simplicity.

Configuration

As illustrated in FIG. 1 to FIG. 8, the connector 10 according to the present exemplary embodiment is what is referred to as a movable (floating) connector. The connector 10 includes a fixed housing 30 placed on (fixed to) a circuit board 11 (omitted from illustration except for in FIG. 7), and a movable housing 14 disposed so as to be capable of moving relative to the fixed housing 30 and configured to fit together in a fitting direction Z with a counterpart connector 12 serving as a connection target (omitted from illustration except for in FIG. 1). The circuit board corresponds to a substrate of the present disclosure.

The connector 10 further includes plural signal terminals 50 that span between the fixed housing 30 and the movable housing 14 in an array-orthogonal direction Y that is also orthogonal to the fitting direction Z, and that are arrayed along an array direction X that is orthogonal to both the fitting direction Z and the array-orthogonal direction Y. The connector 10 also includes a pair of power source terminals 70 that span between the fixed housing 30 and the movable housing 14 in the array direction X.

The connector 10 configures a plug of a board-to-board connector. The counterpart connector 12 configures a receptacle that is placed on (fixed to) a counterpart circuit board separate to the circuit board described above. The counterpart connector 12 is provided with plural counterpart signal terminals, not illustrated in the drawings, that electrically connect to the plural signal terminals 50, and a pair of counterpart power source terminals, not illustrated in the drawings, that electrically connect to the pair of power source terminals 70.

Note that the connection target of the connector 10 is not limited to the counterpart connector 12, and may be a busbar or a square pin header. In the present exemplary embodiment, the fitting direction Z is aligned with the connector 10 up-down direction, the array-orthogonal direction Y is aligned with the connector 10 left-right direction, and the array direction X is aligned with the connector 10 front-rear direction. In the following explanation, the fitting direction Z is also referred to as the up-down direction, the array-orthogonal direction Y is also referred to as the left-right direction, and the array direction X is also referred to as the front-rear direction. The shape of the connector 10 is symmetrical about the front-rear direction and the left-right direction.

Movable Housing

As illustrated in FIG. 1 to FIG. 3 and FIG. 5 to FIG. 8, the movable housing 14 is formed in a substantially rectangular tube shape (substantially rectangular block shape) that has a bottom and includes an upward-opening rectangular hole 16. The movable housing 14 is integrally provided with a pair of left and right side walls 14A, 14B opposing each other in the left-right direction, a pair of front and rear coupling walls 14C, 14D respectively linking together front and rear end portions of the left and right side walls 14A, 14B in the left-right direction, and a bottom wall 14E (see FIG. 8) linking together the left and right side walls 14A, 14B in the left-right direction and also linking together the front and rear coupling walls 14C, 14D in the front-rear direction. The left and right side walls 14A, 14B each extend along the front-rear direction, and the front and rear coupling walls 14C, 14D each extend along the left-right direction. The front and rear coupling walls 14C, 14D correspond to opposing walls of the present disclosure. The bottom wall 14E is provided substantially in the lower half of the movable housing 14, and is formed so as to be thick in the up-down direction. The movable housing 14 is manufactured from an insulating material such as a synthetic resin. Note that although the movable housing 14 of the present exemplary embodiment is formed with an elongated shape with its length in the front-rear direction, the front-rear direction dimension of the movable housing 14 may be modified as appropriate according to the number of the signal terminals 50.

A pair of left and right engaging protrusions 18 are formed on both left and right sides of lower end portions of the front and rear coupling walls 14C, 14D (at both front and rear end portions of the movable housing 14). The engaging protrusions 18 project toward the left-right direction outer side (the array-orthogonal direction Y outer side). The engaging protrusions 18 are formed in rectangular block shapes, and are configured to limit movement of the movable housing 14 relative to the fixed housing 30 to within a predetermined range.

Faces on the hole 16 side of the left and right side walls 14A, 14B are formed with plural signal terminal insertion grooves 20A that extend along the up-down direction at uniform intervals in the front-rear direction. The signal terminal insertion grooves 20A open toward the hole 16 and toward the upper side. The signal terminal insertion grooves 20A are in communication with plural signal terminal insertion holes 20B that penetrate the bottom wall 14E in the up-down direction. Lower end portions of the plural signal terminal insertion holes 20B configure groove shaped grooved portions 20B1 opening toward both left-right direction sides of the respective side walls 14A, 14B. As viewed along the up-down direction, the signal terminal insertion grooves 20A and the signal terminal insertion holes 20B are formed with elongated profiles with their length along the left-right direction, and configure signal terminal insertion portions 20.

Accommodation recesses 22 that are recessed toward the front-rear direction inside (array direction X inside) are formed in the front and rear coupling walls 14C, 14D at left-right direction central portions of side faces on the front-rear direction outer sides thereof (on the opposite sides to the hole 16). The front and rear accommodation recesses 22 extend along the up-down direction, and are open toward the front-rear direction outer side (the array direction X outer side) and both up-down direction sides.

Fixed Housing

As illustrated in FIG. 1 to FIG. 2 and FIG. 4 to FIG. 8, the fixed housing 30 is formed in a substantially rectangular frame shape due to being provided with a rectangular through hole 32 penetrating the fixed housing 30 in the up-down direction. The fixed housing 30 is integrally provided with a pair of left and right first side walls 30A, 30B opposing each other in the left-right direction, and a pair of front and rear second side walls 30C, 30D respectively linking together both front-rear direction end portions of the left and right first side walls 30A, 30B in the left-right direction. The left and right first side walls 30A, 30B extend along the front-rear direction (array direction X), and the front and rear second side walls 30C, 30D extend along the left-right direction (array-orthogonal direction Y). The fixed housing 30 is manufactured from an insulating material such as a synthetic resin. Note that although the fixed housing 30 of the present exemplary embodiment is formed in an elongated shape with its length in the front-rear direction, the front-rear direction dimension of the fixed housing 30 may be modified as appropriate according to the number of the signal terminals 50.

Substantially the lower half of the movable housing 14 is inserted inside the through hole 32 of the fixed housing 30, and substantially the upper half of the movable housing 14 is disposed at the upper side (outer side) of the fixed housing 30. A gap 34 (omitted from illustration except for in FIG. 5 and FIG. 6) is formed between inner peripheral faces of the through hole 32 in the fixed housing 30 and outer peripheral faces of the substantially lower half of the movable housing 14. The gap 34 has a substantially rectangular ring shape as viewed along the up-down direction. Four engagement protrusions 33 (omitted from illustration except for in FIG. 4 to FIG. 6) are formed at the four corners of the through hole 32 so as to oppose the four engaging protrusions 18 formed to the movable housing 14 from the upper side. The four engaging protrusions 18 abut the engagement protrusions 33 in case in which, for example, removing the counterpart connector 12 from the connector 10 toward the upper side. Movement of the movable housing 14 toward the upper side relative to the fixed housing 30 is thus limited.

Plural signal terminal insertion holes 36 are formed penetrating front-rear direction intermediate portions of the left and right first side walls 30A, 30B in the up-down direction at uniform intervals along the front-rear direction. Lower end portions of the plural signal terminal insertion holes 36 configure groove shaped grooved portions 36A opening toward both left-right direction sides of the first side walls 30A, 30B.

Spring accommodation recesses 40 recessed toward the front-rear direction outer side (the array direction X outer side) are formed in left-right direction central portions of front-rear direction inside (through hole 32 side) side faces of the front and rear second side walls 30C, 30D. The front and rear spring accommodation recesses 40 open toward the movable housing 14 and toward both up-down direction sides. Lower portions of left-right direction intermediate portions of the front and rear second side walls 30C, 30D are formed with the power source terminal insertion holes 38 opening onto lower faces of the front and rear second side walls 30C, 30D. Front and rear power source terminal insertion holes 38 are formed in an elongated profile with their length along the front-rear direction as viewed along the up-down direction. The power source terminal insertion holes 38 are formed so as to be wider in the left-right direction than the spring accommodation recesses 40, and are in communication with the spring accommodation recesses 40. Note that portions of the lower faces of the front and rear second side walls 30C, 30D that are peripheral to the power source terminal insertion holes 38 are configured by lower face recesses 39 recessed toward the upper side.

Signal Terminals

Figure 9:
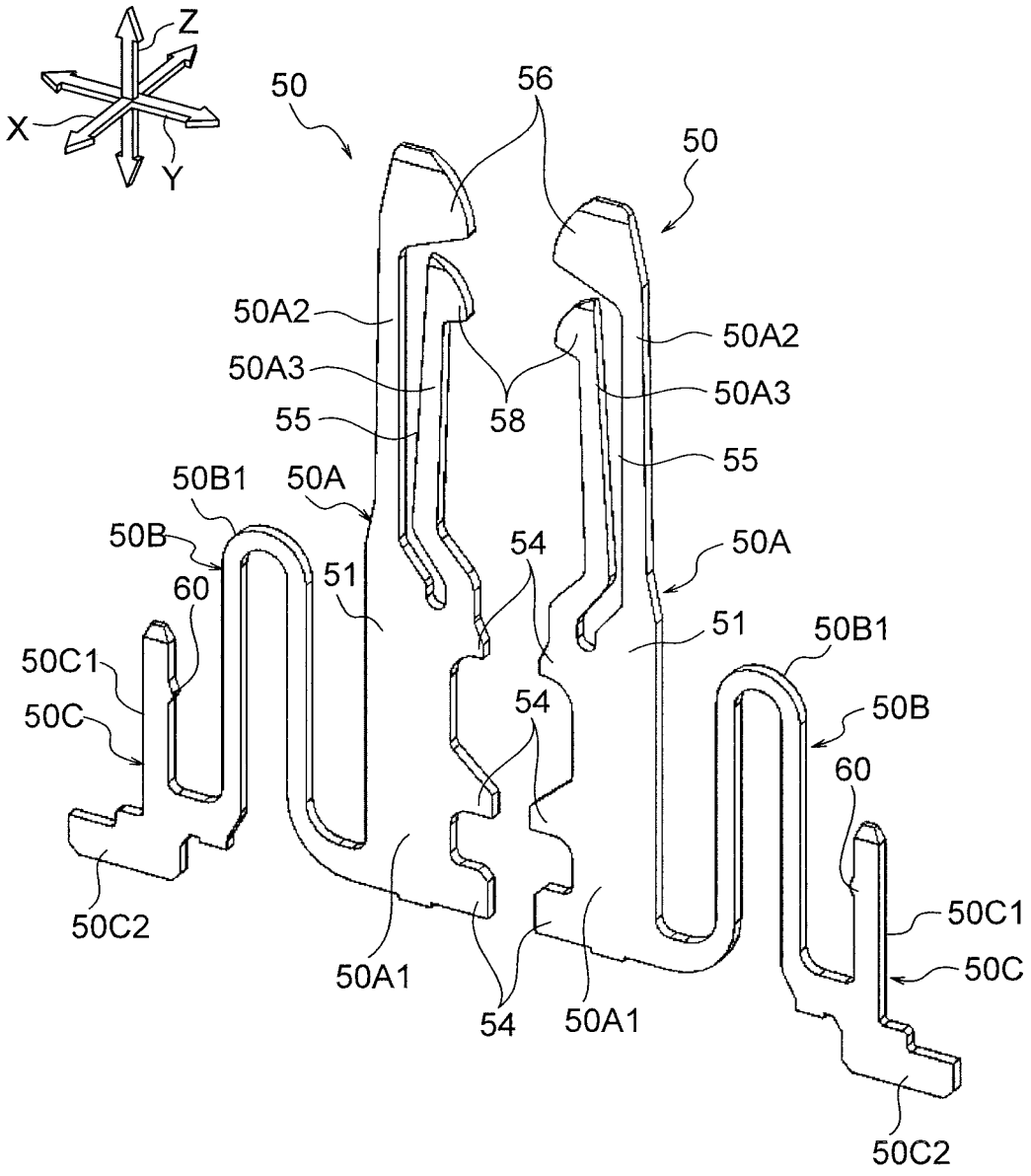
FIG. 9 is a perspective view illustrating a signal terminal according to an exemplary embodiment of the present disclosure.
Figure 10:
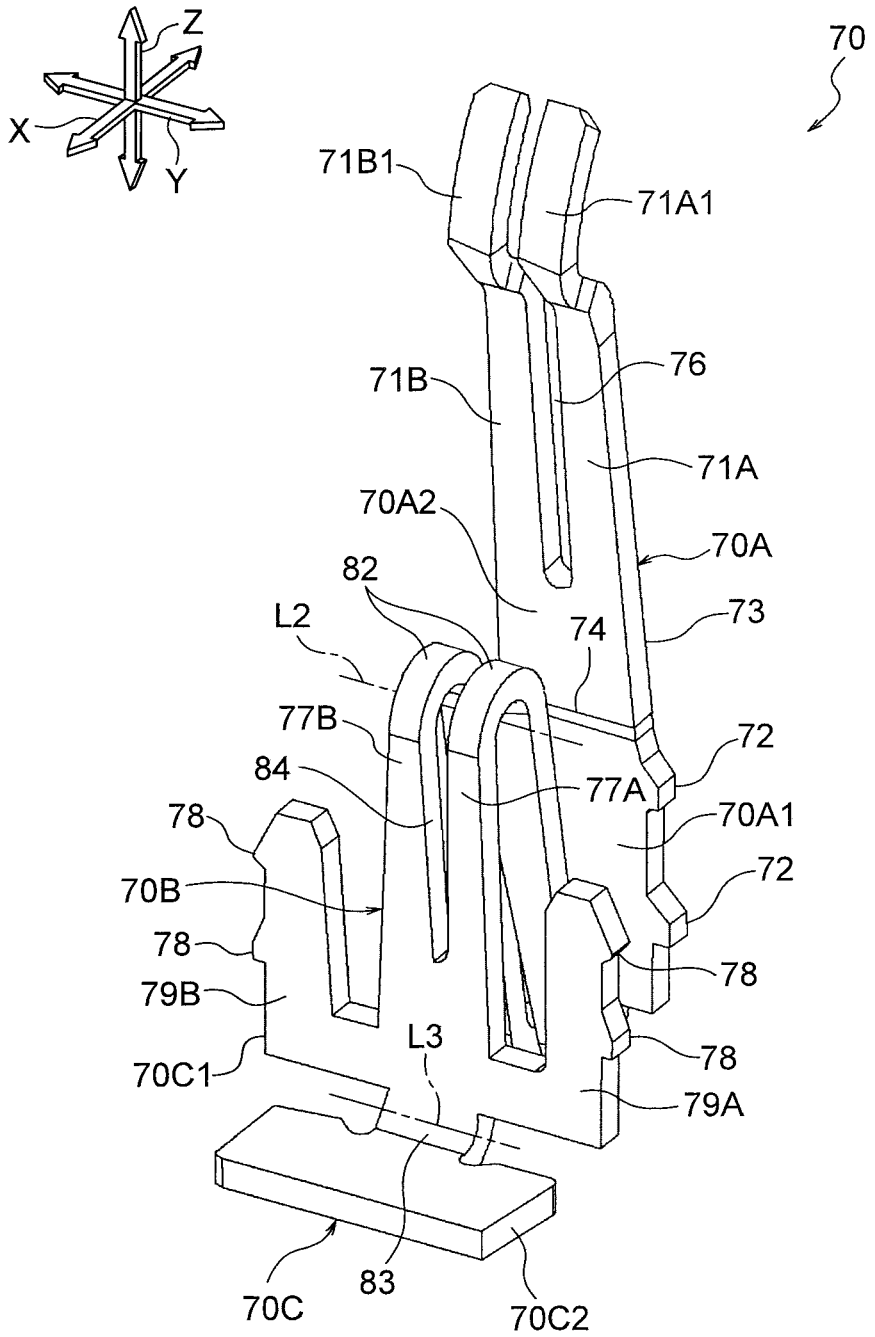
FIG. 10 is a perspective view illustrating a power source terminal according to an exemplary embodiment of the present disclosure.
Figure 11:
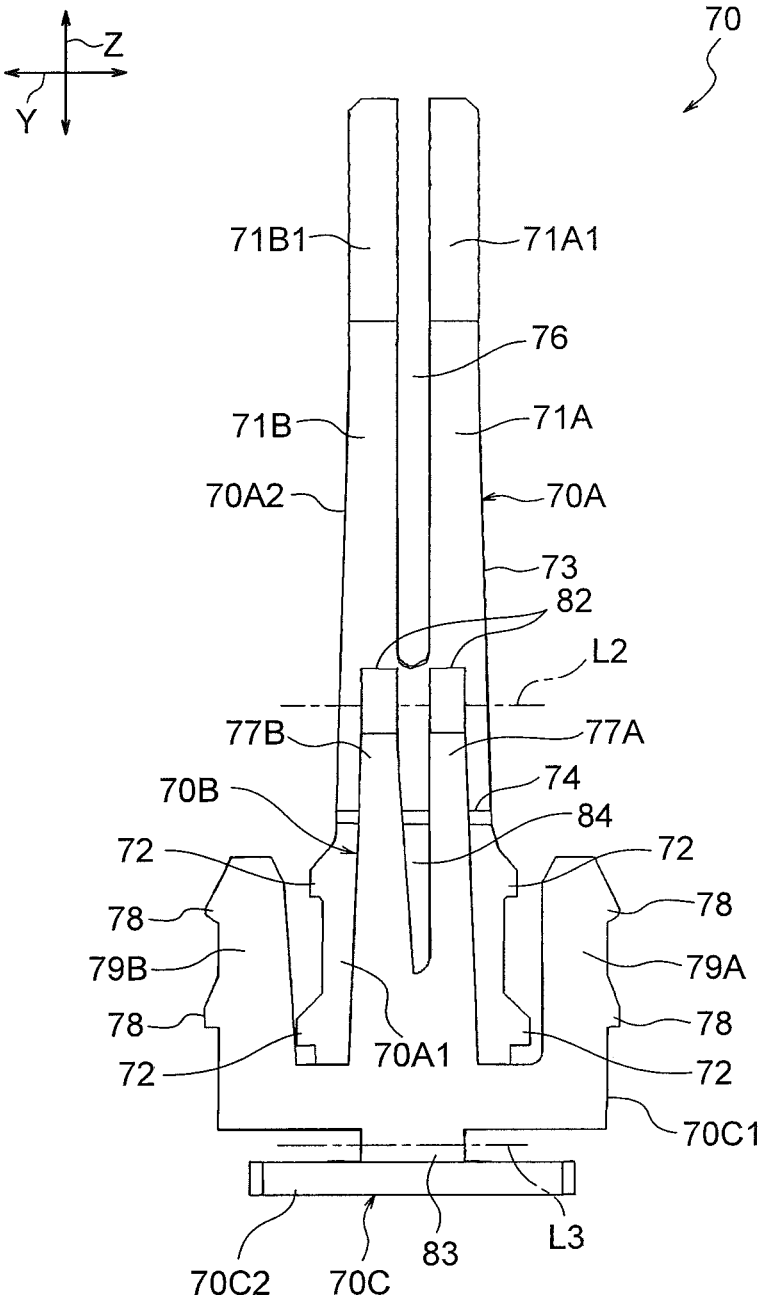
FIG. 11 is a front view illustrating a power source terminal according to an exemplary embodiment of the present disclosure.
Figure 12:
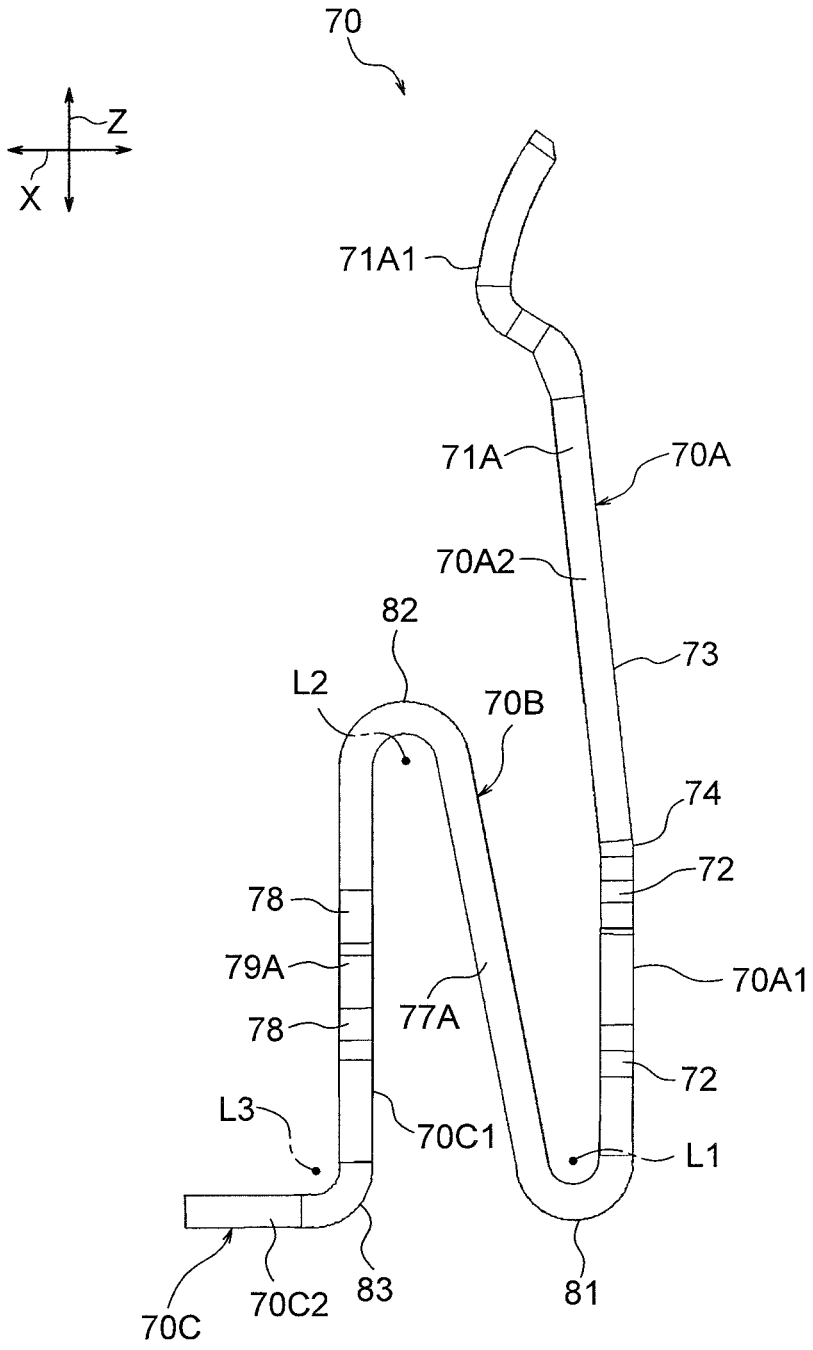
FIG. 12 is a side view illustrating a power source terminal according to an exemplary embodiment of the present disclosure.
Figure 13:
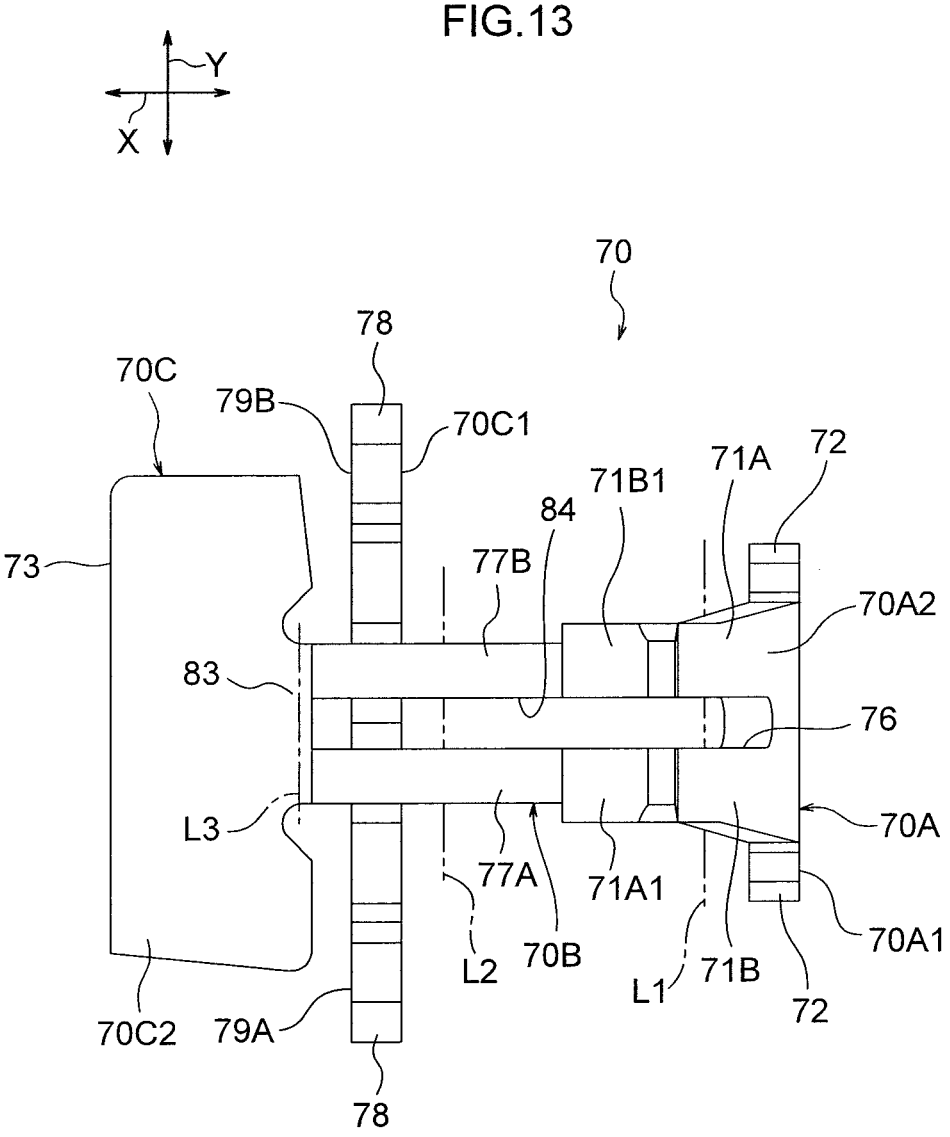
FIG. 13 is a bottom view illustrating a power source terminal according to an exemplary embodiment of the present disclosure.
Figure 14:
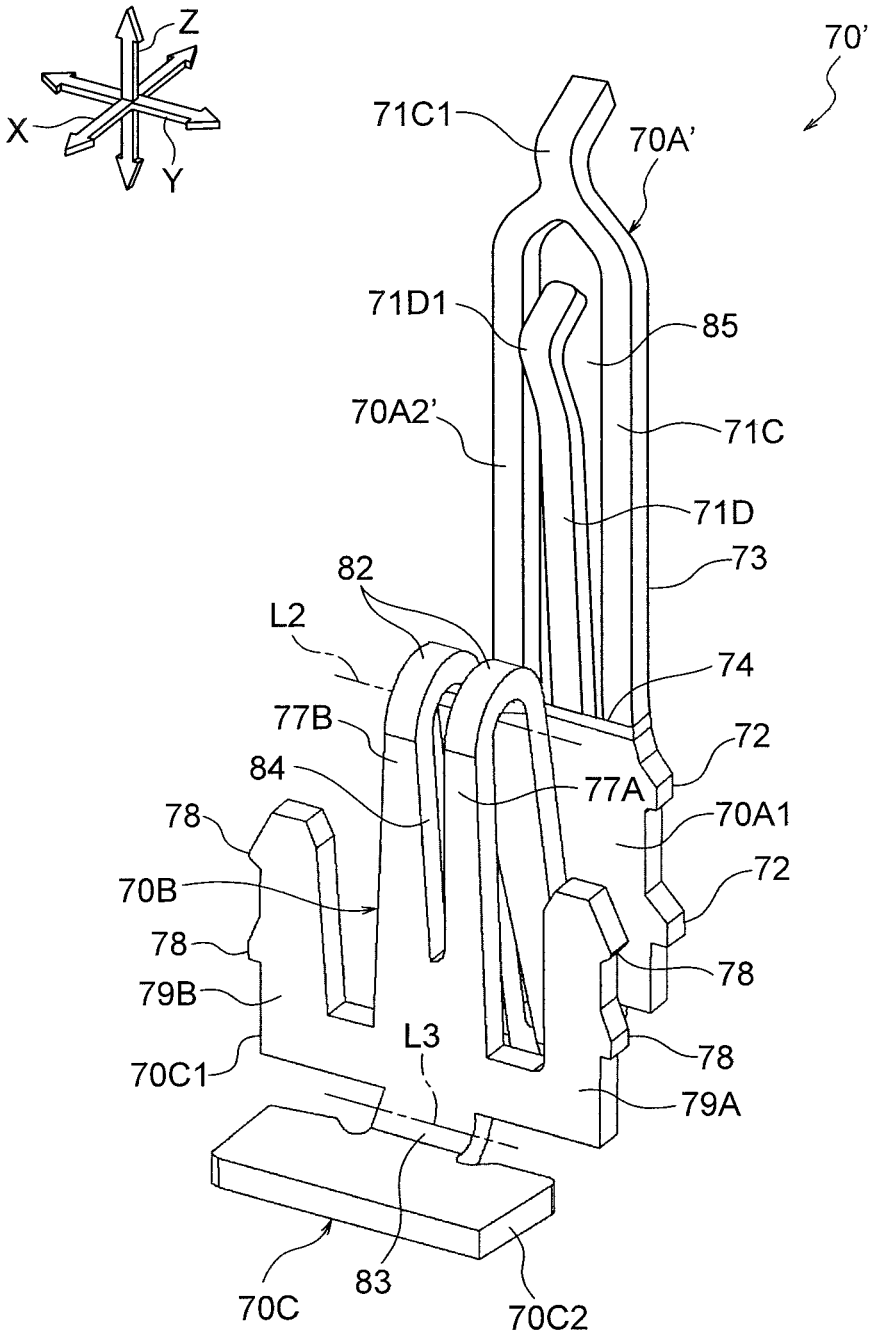
FIG. 14 is a perspective view corresponding to FIG. 10 illustrating a modified example of a power source terminal.

As illustrated in FIG. 1 to FIG. 2 and FIG. 5 to FIG. 9, the plural signal terminals 50 are manufactured by punching an electrically conductive metal sheet 51 (see FIG. 9) into a predetermined shape, and are configured in a pair of left and right terminal arrays 52A, 52B. The left and right terminal arrays 52A, 52B are each configured by plural of the signal terminals 50 arranged at uniform intervals along the front-rear direction. The plural signal terminals 50 in the left side terminal array 52A and the plural signal terminals 50 in the right side terminal array 52B are formed with the same shapes as each other, but are disposed so as to be oriented in opposite directions to each other in the left-right direction. The plural signal terminals 50 of the left side terminal array 52A span between the left side first side wall 30A of the fixed housing 30 and the movable housing 14 in the left-right direction, and the plural signal terminals 50 of the right side terminal array 52B span between the right side first side wall 30B of the fixed housing 30 and the movable housing 14 in the left-right direction. Note that FIG. 9 illustrates one of the signal terminals 50 of the left side terminal array 52A and one of the signal terminals 50 of the right side terminal array 52B.

Each of the signal terminals 50 includes a first connection portion 50C that is retained at either the first side wall 30A or the first side wall 30B of the fixed housing 30 and thus fixed to the circuit board, a first contact portion 50A that is retained at the movable housing 14 and that is configured to make an electrical contact (connection) with a counterpart signal terminal provided to the counterpart connector 12 and that elastically deforms toward the left-right direction outer side, and an elastically deformable first elastic portion 50B that is positioned between the first connection portion 50C and the first contact portion 50A. The first elastic portion 50B is integral to the first contact portion 50A, and extends from the first contact portion 50A toward the left-right direction outer side, and the first connection portion 50C is integral to the first elastic portion 50B and extends toward the left-right direction outer side from an end portion of the first elastic portion 50B on the opposite side to the first contact portion 50A.

The first contact portion 50A is formed in an elongated plate shape with a sheet thickness direction oriented in the front-rear direction and a length direction oriented in the up-down direction, and is inserted into the corresponding signal terminal insertion portion 20 of the movable housing 14 from the lower side. Substantially the lower half of the first contact portion 50A configures a first retention portion 50A1 that is inserted (press-fitted) into the corresponding signal terminal insertion hole 20B in the movable housing 14. Plural claws 54 projecting toward the left-right direction central side of the movable housing 14 are formed to the first retention portion 50A1 so as to be arrayed along the up-down direction. The plural claws 54 are configured to dig into an inner peripheral face of the signal terminal insertion hole 20B so as to retain the first retention portion 50A1 in the movable housing 14.

Substantially the upper half of the first contact portion 50A configures a pair of left and right first contact point elastic portions 50A2, 50A3, partitioned in the left-right direction by a slit 55 extending in the up-down direction. The first contact point elastic portions 50A2, 50A3 are inserted into the signal terminal insertion grooves 20A of the movable housing 14, and are elastically deformable in the left-right direction. The first contact point elastic portion 50A2 on the left-right direction outer side extends further toward the upper side than the first contact point elastic portion 50A3 on the left-right direction central side. Upper end portions of the left and right first contact point elastic portions 50A2, 50A3 are formed with first contact point portions 56, 58 configured to project into the hole 16 of the movable housing 14. The first contact point portions 56, 58 are configured to contact the counterpart signal terminals provided to the counterpart connector 12. The signal terminals 50 are electrically connected to the counterpart signal terminals in this manner. Configuration is made such that even if one out of the first contact point portions 56, 58 is damaged, the electrical connection is secured by the other out of the first contact point portions 56, 58.

The first connection portion 50C includes a first press-fit portion 50C1 configured to be inserted (press-fitted) into the corresponding signal terminal insertion hole 36 in the fixed housing 30 from the lower side, and a first connection tab 50C2 extending from a lower end of the first press-fit portion 50C1 toward the left-right direction outer side, and configured to be inserted into the grooved portion 36A of the signal terminal insertion hole 36. The first connection portion 50C is formed in a substantially L-shape as viewed along the front-rear direction. An upper portion of the first press-fit portion 50C1 is formed with a claw 60 projecting toward the left-right direction central side of the fixed housing 30. The claw 60 hooks onto the inner peripheral face of the signal terminal insertion hole 36 to retain the first press-fit portion 50C1 in the fixed housing 30. The first connection tab 50C2 projects further to the left-right direction outer side than the fixed housing 30. The first connection tab 50C2 is fixed (electrically connected) to the circuit board by soldering or the like.

The first elastic portion 50B configures a left-right direction intermediate portion of the signal terminal 50, is integral to the first contact portion 50A, and extends from a lower end of the first contact portion 50A toward the left-right direction outer side. The first connection portion 50C is integral to the first elastic portion 50B, and extends from an end portion of the first elastic portion 50B on the opposite side to the first contact portion 50A. A left-right direction intermediate portion of the first elastic portion 50B protrudes upward (in a removal direction of the counterpart connector 12) and is bent into a first spring portion 50B1. The first spring portion 50B1 is configured in an inverted U-shape opening toward the lower side as viewed along the front-rear direction.

Power Source Terminals

As illustrated in FIG. 1 to FIG. 2, FIG. 5 to FIG. 8, and FIG. 10 to FIG. 13, the pair of power source terminals 70 are manufactured by punching and then bending an electrically conductive metal sheet 73 (see FIG. 10 to FIG. 13). The metal sheet 73 corresponds to a sheet member of the present disclosure, and includes plural bent portions 81 to 83 bent about plural bend axes L1 to L3 that extend in the array-orthogonal direction Y. The sheet thickness direction of the metal sheet 73 is oriented in a direction orthogonal to the array-orthogonal direction Y. The pair of power source terminals 70 are disposed on both front-rear direction sides of the plural signal terminals 50. The pair of power source terminals 70 are formed with the same shapes as each other, but are disposed so as to be oriented in opposite directions to each other in the front-rear direction. Each of the power source terminals 70 is formed in an elongated shape with its length direction along the up-down direction, and the power source terminals 70 span between the pair of second side walls 30C, 30D of the fixed housing 30 and the movable housing 14.

Each of the power source terminals 70 includes a second connection portion 70C retained at the corresponding second side wall 30C or 30D and fixed to the circuit board, a second contact portion 70A retained at the movable housing 14 and configured to make an electrical contact (connection) with the corresponding counterpart power source terminal provided to the counterpart connector 12, and an elastically deformable second elastic portion 70B positioned between the second connection portion 70C and the second contact portion 70A. The second elastic portion 70B is integral to the second contact portion 70A and extends from a lower end portion of the second contact portion 70A toward the front-rear direction outer side, and the second connection portion 70C is integral to the second elastic portion 70B and extends from a front-rear direction outer side and lower side end portion of the second elastic portion 70B toward both sides in the left-right direction and also toward the front-rear direction outer side.

The second contact portion 70A is formed in an elongated plate shape with a sheet thickness direction oriented in the front-rear direction (array direction X) and a length direction oriented in the up-down direction. Namely, a portion configuring the second contact portion 70A of the metal sheet 73 described above is disposed with its sheet thickness direction oriented in the array direction X. A sheet thickness dimension of the second contact portion 70A in the front-rear direction is set smaller than a left-right direction width dimension of the second contact portion 70A. Part of the second contact portion 70A (the majority of the second contact portion 70A, but excluding left and right second contact point portions 71A1, 71B1, described later) is accommodated in the corresponding accommodation recess 22 of the movable housing 14. A lower portion of the second contact portion 70A configures a second retention portion 70A1. The second retention portion 70A1 is inserted (press-fitted) into a lower portion of the accommodation recess 22 of the movable housing 14. Plural claws 72 projecting toward both left-right direction sides are formed to the second retention portion 70A1 so as to be arrayed in the up-down direction. The plural claws 72 dig into left and right side faces of the accommodation recess 22 so as to retain the second retention portion 70A1 in the movable housing 14.

An up-down direction intermediate portion and upper portion of the second contact portion 70A configures a second contact point elastic portion 70A2 that is capable of elastically deforming in the front-rear direction. The second contact point elastic portion 70A2 extends from an up-down direction intermediate portion to an upper portion inside the accommodation recess 22. The second contact point elastic portion 70A2 is formed such that a left-right direction width thereof decreases slightly on progression upward, and the second contact point elastic portion 70A2 is disposed in a state in which it does not contact the left and right side faces of the accommodation recess 22. A kinked portion 74 is formed between the second contact point elastic portion 70A2 and the second retention portion 70A1, such that the second contact point elastic portion 70A2 is slightly inclined with respect to the up-down direction so as to project toward the front-rear direction outer side on progression upward. A gap 22A (see FIG. 8) that allows the second contact point elastic portion 70A2 to elastically deform toward the plural signal terminals 50 (the front-rear direction inside of the movable housing 14) is thus formed between the second contact point elastic portion 70A2 and a bottom face of the accommodation recess 22.

An upper portion of the second contact point elastic portion 70A2 is partitioned into a pair of left and right partitioned portions 71A, 71B by a slit 76 extending in the up-down direction. Upper portions of the left and right partitioned portions 71A, 71B are provided with the second contact point portions 71A1, 71B1 that bulge in a substantially circular arc shape toward the front-rear direction outer side. The second contact point portions 71A1, 71B1 project toward the front-rear direction outer side of the accommodation recess 22, and contact the corresponding counterpart power source terminal provided to the counterpart connector 12. The power source terminal 70 is thereby electrically connected to the counterpart power source terminal. Configuration is made such that even if one out of the second contact point portions 71A1, 71B1 is damaged, the electrical connection is secured by the other out of the second contact point portions 71A1, 71B1. Note that configuration is not limited to one in which the upper portion of the second contact point elastic portion 70A2 is partitioned into the left and right partitioned portions 71A, 71B (left and right second contact point portions 71A1, 71B1) by the slit 76, and configuration may be made in which the slit 76 is omitted.

Each of the left and right second connection portions 70C includes a second press-fit portion 70C1 configured to be inserted (press-fitted) into the corresponding power source terminal insertion hole 38 in the fixed housing 30 from the lower side, and a second connection tab 70C2 extending from a lower end of the second press-fit portion 70C1 toward the front-rear direction outer side and also toward both left-right direction sides. Each of the second connection portions 70C is formed in a substantially L-shape as viewed along the left-right direction. A portion of the second connection tab 70C2 on the second press-fit portion 70C1 side configures the bent portion 83 that is bent about the bend axis L3 extending in the array-orthogonal direction Y, and a left-right direction dimension of the second connection tab 70C2 is reduced at the bent portion 83. The second press-fit portion 70C1 is configured by a pair of left and right press-fitting tabs 79A, 79B extending from a front-rear direction outer side and lower side end portion of the second elastic portion 70B toward both left-right direction sides and then toward the upper side. The left and right press-fitting tabs 79A, 79B are formed with plural claws 78 arrayed along the up-down direction so as to project toward both left-right direction sides. The claws 78 dig into inner faces of the power source terminal insertion hole 38 so as to retain the second press-fit portion 70C1 in the fixed housing 30. The second connection tab 70C2 is inserted into the corresponding lower face recess 39 of the fixed housing 30 and projects to the front-rear direction outer side of the fixed housing 30. The second connection portion 70C is fixed (electrically connected) to the circuit board by soldering or the like.

The second elastic portion 70B extends from a lower end of the second retention portion 70A1 of the second contact portion 70A toward the upper side and front-rear direction outer side, and then bends toward the front-rear direction outer side and extends toward the lower side such that the second elastic portion 70B is configured substantially in an inverted U-shape as viewed along the left-right direction. The second elastic portion 70B includes the pair of bent portions 81, 82 respectively bent about the pair of bend axes L1, L2 extending along the array-orthogonal direction Y. The second elastic portion 70B is partitioned into a pair of left and right partitioned portions 77A, 77B by a slit 84 extending along the length direction of the second elastic portion 70B. Part of the second elastic portion 70B (a portion corresponding to substantially the front-rear direction outer side half thereof) is accommodated in the corresponding spring accommodation recess 40 formed in the second side wall 30C or 30D of the fixed housing 30.

Operation and Advantageous Effects

Explanation follows regarding operation and advantageous effects of the present exemplary embodiment.

In the connector 10 configured as described above, the plural signal terminals 50 and the pair of power source terminals 70 each span between the fixed housing 30 and the movable housing 14, and the first elastic portions 50B of the signal terminals 50 and the second elastic portions 70B of the power source terminals 70 elastically deform so as to permit movement of the movable housing 14 relative to the fixed housing 30.

In the connector 10, the fixed housing 30 includes the first side walls 30A, 30B extending in the array direction X of the plural signal terminals 50, and the second side walls 30C, 30D extending along the array-orthogonal direction Y that is orthogonal to both the fitting direction Z of the counterpart connector 12 and the array direction X. The plural signal terminals 50 span between the first side walls 30A, 30B and the movable housing 14, and the pair of power source terminals 70 span between the second side walls 30C, 30D and the movable housing 14. Namely, since the terminals 50, 70 respectively span between the first side walls 30A, 30B and the movable housing 14 and the second side walls 30C, 30D and the movable housing 14, the first side walls 30A, 30B and the second side walls 30C, 30D extending in two mutually orthogonal directions to each other, any variation in the distance between the first side walls 30A, 30B and the movable housing 14 and the second side walls 30C, 30D and the movable housing 14 can be corrected from these two directions by the respective terminals 50, 70. This facilitates the prevention of lopsidedness in a movable region of the movable housing 14 with respect to the fixed housing 30, and also facilitates placement (centering) of the movable housing 14 at a central portion of the through hole 32 of the fixed housing 30. As a result, any fitting misalignment between the connector 10 and the counterpart connector 12 is easily and appropriately absorbed.

In the connector 10, the movable housing 14 includes the hole 16 into which the counterpart connector 12 fits, and also includes the pair of side walls 14A, 14B opposing each other across the hole 16 in a direction orthogonal both to the fitting direction Z of the counterpart connector 12 and to the array direction X. The pair of coupling walls 14C, 14D oppose each other across the hole 16 in the array direction X and link together the array direction X end portions of the pair of side walls 14A, 14B. Moreover, the second contact portions 70A of the power source terminals 70 that make electrical contact with the counterpart connector 12 are retained at array direction X side faces (portions configuring dead space) of the coupling walls 14C, 14D. This enables a reduction in the size of the movable housing 14 in the array direction X in comparison to a configuration in which the second contact portions 70A of the power source terminals 70 are retained at array-orthogonal direction Y side faces of the coupling walls 14C, 14D.

Moreover, in the connector 10, the plural signal terminals 50 span between the first side walls 30A, 30B and the movable housing 14, separately to the pair of power source terminals 70 that span between the second side walls 30C, 30D and the movable housing 14. Accordingly, even when the fixed housing 30 and the movable housing 14 are reduced in size along the array direction X, the plural signal terminals 50 can be prevented from becoming too close to the pair of power source terminals 70. This facilitates the prevention of short circuiting due to tracking or the like as a result.

In the connector 10, the second side walls 30C, 30D of the fixed housing 30 are disposed on both array direction X sides of the movable housing 14, and the power source terminals 70 span between the second side walls 30C, 30D and the movable housing 14. Variation in the distance between the second side walls 30C, 30D and the movable housing 14 in the array direction X can accordingly be corrected from mutually opposing directions by the respective power source terminals 70. This further facilitates the prevention of lopsidedness in the movable region of the movable housing 14 with respect to the fixed housing 30.

In the connector 10, the movable housing 14 includes the coupling walls 14C, 14D (opposing walls) that oppose the respective second side walls 30C, 30D of the fixed housing 30 in the array direction X of the plural signal terminals 50. The second contact portions 70A of the power source terminals 70 are retained at the coupling walls 14C, 14D, and elastically deform toward the plural signal terminals 50 in case in which an electrical contact is formed with the counterpart connector 12. There is accordingly no need to secure a space for elastic deformation of the second contact portions 70A on the opposite sides to the plural signal terminals 50 (the array direction X outer sides). Moreover, the coupling walls 14C, 14D are formed with the accommodation recesses 22 that open toward the array direction X outer side and that accommodate part of the respective second contact portions 70A, making it easy to secure placement space for the second contact portions 70A in case in which reducing the size of the overall configuration of the connector 10 in the array direction X.

In the connector 10, the second side walls 30C, 30D of the fixed housing 30 are formed with the spring accommodation recesses 40 that open toward the movable housing 14 in the array direction X of the plural signal terminals 50, and that accommodate part of the respective second elastic portions 70B of the power source terminals 70. This makes it even easier to secure placement space for the second elastic portions 70B in case in which reducing the size of the overall configuration of the connector 10 in the array direction X.

In other words, in the connector 10, the accommodation recesses 22 and the spring accommodation recesses 40 are formed in dead space utilized as placement space for the movable housing 14 and fixed housing 30. Part of the second contact portions 70A and the second elastic portions 70B are accommodated in these recesses 22, 40, thereby facilitating a reduction in size of the overall configuration of the connector 10 in the array direction X.

Moreover, in the connector 10, each of the power source terminals 70 is configured from the metal sheet 73 that includes the plural bent portions 81 to 83 bent about the plural bend axes L1 to L3 extending in the array-orthogonal direction Y, and that has a sheet thickness direction oriented in a direction orthogonal to the array-orthogonal direction Y. Due to setting the plural bent portions 81 to 83 and the sheet thickness direction of the metal sheet 73 as described above, the elastic deformability of the second elastic portion 70B of the power source terminal 70 in the array direction X can be prevented from suffering even in cases in which the power source terminals 70 are set with a large width dimension in the array-orthogonal direction Y in order to secure a cross-sectional area of the power source terminal 70 that will allow a larger current to flow through the power source terminal 70 than will flow through the respective signal terminals 50. Moreover, a portion of the metal sheet 73 configuring the second contact portion 70A is disposed with its sheet thickness direction oriented in the array direction X, thereby enabling the placement space required for the second contact portion 70A in the array direction X to be made smaller. As a result, this further facilitates a reduction in size of the overall configuration of the connector 10 in the array direction X.

Supplementary Explanation of the Present Exemplary Embodiment

Although a pair of the second contact point portions 71A1, 71B1 are provided in the left-right direction (array-orthogonal direction Y) at the upper end portion of the second contact portion 70A of the power source terminal 70 in the exemplary embodiment described above, there is no limitation thereto. For example, as in a power source terminal 70' (modified example) illustrated in FIG. 14, configuration may be made in which a pair of second contact point portions 71C1, 71D1 are provided along the up-down direction (fitting direction Z) at the upper end portion of the second contact portion 70A'.

In the power source terminal 70', the configuration of a second contact point elastic portion 70A2' of the second contact portion 70A' differs from that in the power source terminal 70 according to the exemplary embodiment described above. However, the configuration is similar to that of the power source terminal 70 in other respects. The second contact point elastic portion 70A2' of the power source terminal 70' is formed with a slit (opening) 85 with a substantially inverted U-shape as viewed along the front-rear direction (array direction X). The second contact point elastic portion 70A2' is thus partitioned into an outer partitioned portion 71C configured in a substantially inverted U-shape as viewed along the front-rear direction and an inner partitioned portion 71D disposed at the inside of the outer partitioned portion 71C.

Second contact point portions 71C1, 71D1 that bulge in a substantially circular arc shape toward the front-rear direction outer side are provided at upper end portions of the outer partitioned portion 71C and the inner partitioned portion 71D. The second contact point portions 71C1, 71D1 are arrayed in the up-down direction (fitting direction Z), and project toward the front-rear direction outer side of the corresponding accommodation recess 22. The second contact point portions 71C1, 71D1 contact the corresponding counterpart power source terminal provided to the counterpart connector 12 so as to electrically connect the power source terminal 70' to the counterpart power source terminal. Configuration is made such that even if one out of the second contact point portions 71C1, 71D1 is damaged, this electrical connection is secured by the other out of the second contact point portions 71C1, 71D1.

Moreover, in the power source terminal 70', the second contact point portion 71C1 on the upper side slides against the counterpart power source terminal before the second contact point portion 71D1 on the lower side when fitting (connecting) the counterpart connector 12 together with the connector 10. Accordingly, in cases in which an oxide layer has formed on the surface of the counterpart power source terminal, for example, the oxide layer can be scraped off by this sliding, enabling a good connection to be formed between the second contact point portion 71D1 on the lower side and the counterpart power source terminal.

In the exemplary embodiment described above, although configuration is made in which the second contact portions 70A of the power source terminals 70 are retained at side faces on the front-rear direction outer sides (array direction X outer sides) of the coupling walls 14C, 14D (opposing walls) of the movable housing 14, there is no limitation thereto. Namely, the second contact portions 70A of the power source terminals 70 may be retained at side faces on the front-rear direction insides (array direction X insides, hole 16 side) of the coupling walls 14C, 14D.

In the exemplary embodiment described above, although configuration is made in which the second side walls 30C, 30D of the fixed housing 30 are disposed on both array direction X sides of the movable housing 14, and the power source terminals 70 span between the second side walls 30C, 30D and the movable housing 14, there is no limitation thereto. Namely, one out of the second side walls 30C, 30D may be omitted, such that a power source terminal 70 spans between the remaining second side wall 30C or 30D and the movable housing 14 only.

In the exemplary embodiment described above, although configuration is made in which the coupling walls 14C, 14D (opposing walls) of the movable housing 14 are formed with the accommodation recesses 22 that accommodate part of the second contact portions 70A, and the second side walls 30C, 30D of the fixed housing 30 are formed with the spring accommodation recesses 40 that accommodate part of the second elastic portions 70B, there is no limitation thereto. Namely, configuration may be made in which one or both out of the accommodation recesses 22 or the spring accommodation recesses 40 are omitted.

Various other modifications may be implemented within a range not departing from the spirit of the present disclosure. Obviously, the scope of rights encompassed by the present disclosure is not limited by the exemplary embodiment described above.

What is claimed is:

1. A connector comprising:

a fixed housing to be placed on a substrate;

a movable housing disposed so as to be capable of moving relative to the fixed housing, and configured to fit together with a connection target;

a plurality of signal terminals arrayed in an array direction that is orthogonal to a fitting direction of the connection target, with each of the signal terminals spanning between the fixed housing and the movable housing; and a power source terminal spanning between the fixed housing and the movable housing;

the fixed housing including:

a first side wall extending along the array direction, and a second side wall extending along an array-orthogonal direction that is orthogonal to both the fitting direction and the array direction;

each of the plurality of signal terminals including:

a first connection portion retained at the first side wall and configured to be fixed to the substrate, a first contact portion retained at the movable housing and configured to electrically connect to the connection target, and an elastically deformable first elastic portion positioned between the first connection portion and the first contact portion; and the power source terminal including:

a second connection portion retained at the second side wall and configured to be fixed to the substrate, a second contact portion retained at the movable housing and configured to electrically connect to the connection target, and an elastically deformable second elastic portion positioned between the second connection portion and the second contact portion, wherein:

the movable housing includes an opposing wall opposing the second side wall in the array direction;

the second contact portion is retained at the opposing wall, and elastically deforms toward the plurality of signal terminals in a case in which an electrical contact is formed with the connection target; and an accommodation recess opening toward an array direction outer side is formed in the opposing wall so as to accommodate at least part of the second contact portion.

2. A connector comprising:

a fixed housing to be placed on a substrate;

a movable housing disposed so as to be capable of moving relative to the fixed housing, and configured to fit together with a connection target;

a plurality of signal terminals arrayed in an array direction that is orthogonal to a fitting direction of the connection target, with each of the signal terminals spanning between the fixed housing and the movable housing; and a power source terminal spanning between the fixed housing and the movable housing;

the fixed housing including:

a first side wall extending along the array direction, and a second side wall extending along an array-orthogonal direction that is orthogonal to both the fitting direction and the array direction;

each of the plurality of signal terminals including:

a first connection portion retained at the first side wall and configured to be fixed to the substrate, a first contact portion retained at the movable housing and configured to electrically connect to the connection target, and an elastically deformable first elastic portion positioned between the first connection portion and the first contact portion; and the power source terminal including:

a second connection portion retained at the second side wall and configured to be fixed to the substrate, a second contact portion retained at the movable housing and configured to electrically connect to the connection target, and an elastically deformable second elastic portion positioned between the second connection portion and the second contact portion, wherein a spring accommodation recess opening toward the movable housing in the array direction is formed in the second side wall so as to accommodate at least part of the second elastic portion.

3. A connector comprising:

a fixed housing to be placed on a substrate;

a movable housing disposed so as to be capable of moving relative to the fixed housing, and configured to fit together with a connection target;

a plurality of signal terminals arrayed in an array direction that is orthogonal to a fitting direction of the connection target, with each of the signal terminals spanning between the fixed housing and the movable housing; and a power source terminal spanning between the fixed housing and the movable housing:

the fixed housing including:

a first side wall extending along the array direction, and a second side wall extending along an array-orthogonal direction that is orthogonal to both the fitting direction and the array direction;

each of the plurality of signal terminals including:

a first connection portion retained at the first side wall and configured to be fixed to the substrate, a first contact portion retained at the movable housing and configured to electrically connect to the connection target, and an elastically deformable first elastic portion positioned between the first connection portion and the first contact portion; and the power source terminal including:

a second connection portion retained at the second side wall and configured to be fixed to the substrate, a second contact portion retained at the movable housing and configured to electrically connect to the connection target, and an elastically deformable second elastic portion positioned between the second connection portion and the second contact portion, wherein the power source terminal is configured by a sheet member that includes a plurality of bent portions bent about a plurality of bend axes extending along the array-orthogonal direction and that has a sheet thickness direction oriented in a direction that is orthogonal to the array-orthogonal direction, with a portion of the sheet member configuring the second contact portion being disposed with its sheet thickness direction oriented in the array direction.

* * * * *